US005752650A

United States Patent [19]

Henderson

[11] Patent Number: 5,752,650

[45] Date of Patent: May 19, 1998

[54] SHIPPING CARTON WITH FLAP HOLDER FOR PREVENTING SPILLAGE OF PACKING MATERIAL

[75] Inventor: David E. Henderson, Greenwich, Conn.

[73] Assignee: Free-Flow Packaging International, Inc., Redwood City, Calif.

[21] Appl. No.: 678,728

[22] Filed: Jul. 10, 1996

[51] Int. Cl.[6] ..... B65D 5/42

[52] U.S. Cl. ..... 229/125; 206/584; 428/42.2

[58] Field of Search ..... 229/125; 206/584; 428/40.1, 41.8, 42.2, 42.3, 43

[56] References Cited

U.S. PATENT DOCUMENTS

| | | | |
|---|---|---|---|
| 2,765,998 | 10/1956 | Engert | 428/40.1 |
| 2,936,239 | 5/1960 | Rendall | 229/125 |
| 3,035,957 | 5/1962 | Morgan | 428/42.2 |
| 3,607,590 | 9/1971 | Califano | 161/39 |
| 4,164,314 | 8/1979 | Edgar | 229/125 |
| 4,188,427 | 2/1980 | Grass | 428/42.2 |
| 4,514,453 | 4/1985 | Bussey, Jr. | 206/584 |
| 4,624,380 | 11/1986 | Wernette | 229/125 |
| 4,834,820 | 5/1989 | Kondo et al. | 428/43 |
| 5,148,940 | 9/1992 | Mendise | 229/125 |

FOREIGN PATENT DOCUMENTS

| | | | |
|---|---|---|---|
| 1504286 | 3/1978 | United Kingdom | 428/42.2 |

*Primary Examiner*—Gary E. Elkins

*Attorney, Agent, or Firm*—Flehr Hohbach Test Albritton & Herbert LLP

[57] ABSTRACT

Shipping carton and flap holder which prevent the spillage of loose fill materials as an article is removed from the carton. The flap holder includes a strip having first and second end portions with an adhesive on one side thereof for attachment to adjacent flaps of the carton to hold the flaps in an open position as the article is removed. It also has separately removable backings which cover the adhesive on the two end portions of the strip whereby the strip can be affixed to one flap and folded back upon itself for shipment, and thereafter the second backing can be removed and the second end portion can be folded over and affixed to the adjacent flap.

6 Claims, 3 Drawing Sheets

SHIPPING CARTON WITH FLAP HOLDER FOR PREVENTING SPILLAGE OF PACKING MATERIAL

This invention pertains generally to shipping cartons and, more particularly, to cartons in which loose fill packing materials are employed.

Loose fill packing materials are widely used in the protective packing of articles for shipment. They are commonly poured into cartons so as to surround and embrace the articles and thereby cushion and protect them during shipment. To be effective, the loose fill materials must substantially fill the cartons so the articles cannot shift around in them.

One problem with cartons packed in this manner is that the loose fill materials tend to spill over the tops of the cartons when a person digs around in the materials to locate the protected articles. The materials also tend to spill as the articles are removed from the cartons. Being light in weight, the materials also have a tendency to fly about once they get outside the confines of the cartons.

It is in general an object of the invention to provide a new and improved shipping carton and flap holder for use with loose fill materials.

Another object of the invention is to provide a shipping carton and flap holder of the above character which prevent the spillage of loose fill materials as an article is removed from the carton.

These and other objects are achieved in accordance with the invention by providing a shipping carton having closure flaps movable between open and closed positions, a loose fill packing material disposed within and substantially filling the carton, and a flap holder attached to one of the flaps and engagable with another of the flaps for holding the flaps in their open position to prevent spillage of the loose fill material when an article packed in the material is removed from the carton.

Figure 1:
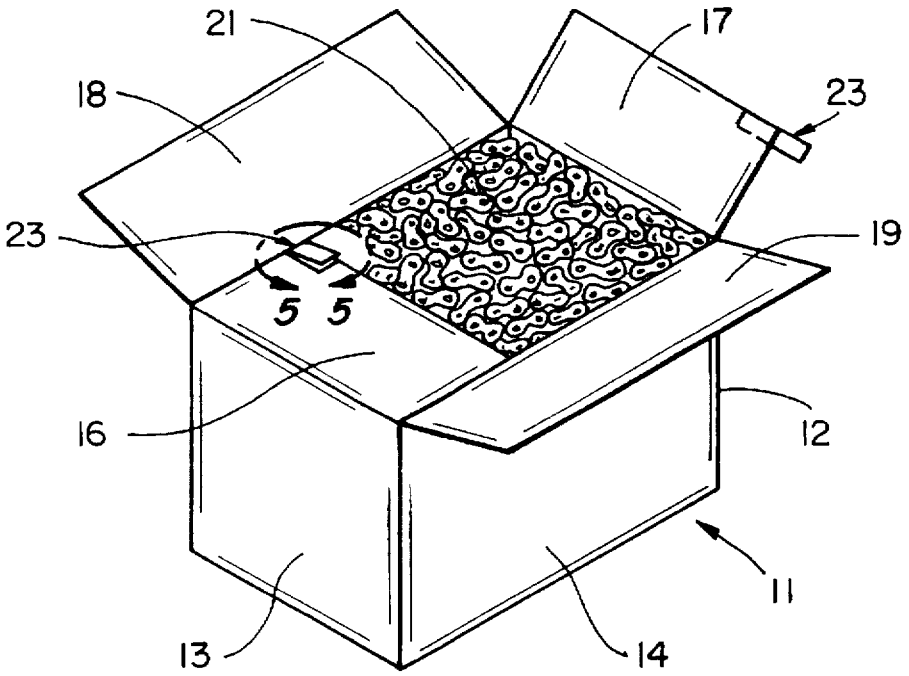
FIG. 1 is an isometric view of one embodiment of a shipping carton with flap holders in accordance with the invention.
Figure 2:
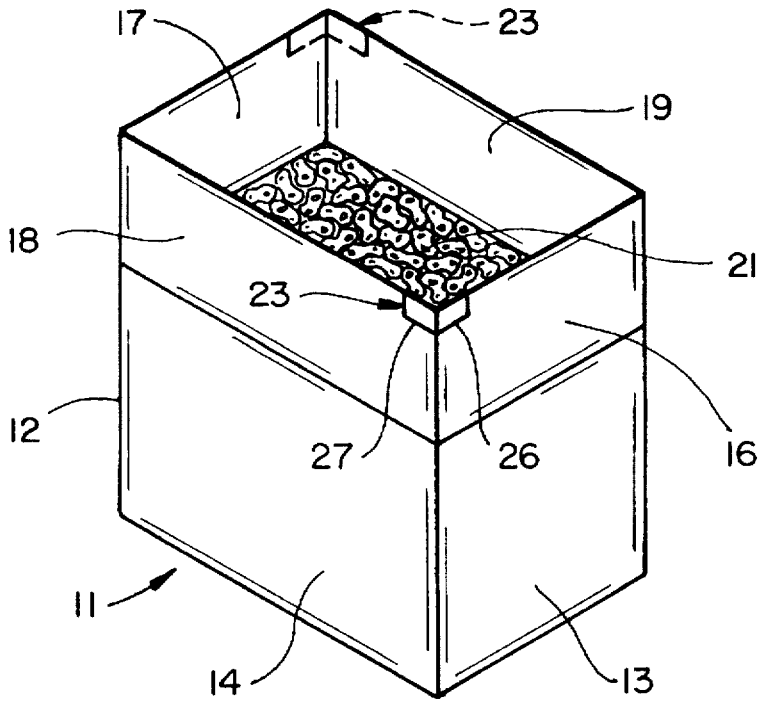
FIG. 2 is an isometric view of the embodiment of FIG. 1, with the flap holders deployed to hold the flaps of the carton in an upright or open position.
Figure 3:
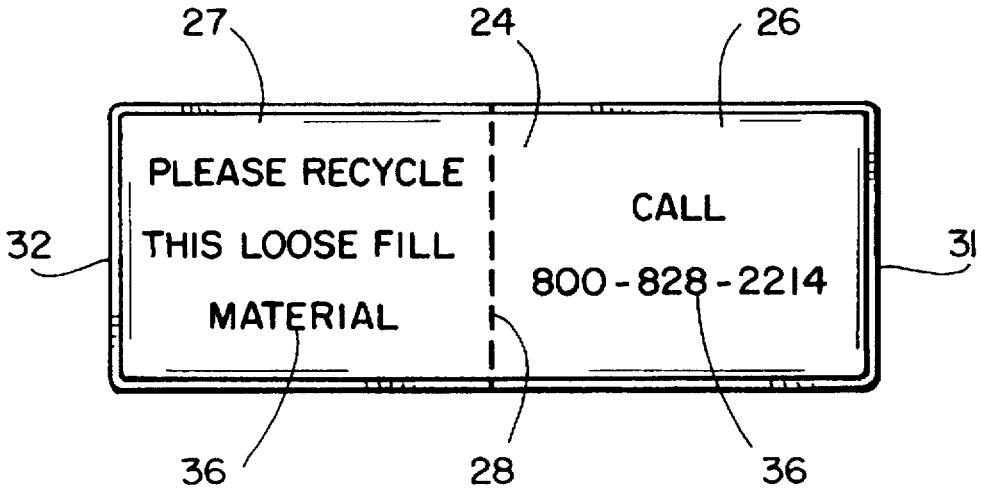
FIG. 3 is a front elevational view of one of the flap holders in the embodiment of FIG. 1.
Figure 4:
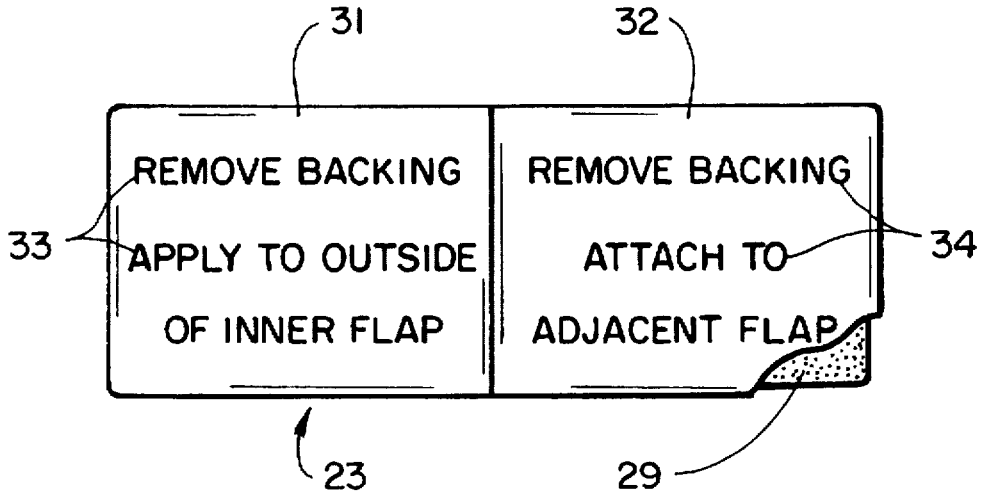
FIG. 4 is a bottom plan view, partly broken away, of the flap holder of FIG. 3.

In the drawings, the invention is illustrated in conjunction with a shipping carton 11 of conventional design. The carton is fabricated of a material such as corrugated cardboard and comprises a rectangular body 12 with end panels 13, side panels 14, and closure flaps 16–19. The flaps are hingedly attached to the upper edges of the body panels for movement between open and closed positions.

End flaps 16, 17 are attached to end panels 13 and are sometimes referred to as the inner flaps since they are folded down first when the carton is closed. Side flaps 18, 19 are attached to side panels 14 and are also referred to as the outer panels since they are folded down over the end panels to complete the closure.

A loose fill packing material 21 is disposed within and substantially fills the carton. This material is poured into the carton so as to surround and cushion one or more articles (not shown) packed within the carton. The loose fill material can be of any suitable type, such as the material shown in U.S. Pat. No. 3,855,053, and can be fabricated of a variety of materials such as foamed plastics, paper, starch and other materials which are biodegradable and/or water soluble.

A pair of flap holders 23 are mounted on the flaps of the carton to hold the flaps in an open or upright position while articles are removed from it. Each of the flap holders comprises a strip 24 of material, such as paper or plastic, which is divided into end sections 26, 27, with a fold line 28 between the two sections. An adhesive 29 is provided on one side of the strip, and removable backings 31, 32 cover the adhesive. The backings are of greater lateral extent than the strip to facilitate removal of the backings from the strip.

Instructions 33, 34 for use of the flap holders are printed on the backings, and instructions 36 for recycling the loose fill material are printed on the exposed side of the strip.

In use, the article to be shipped is packed into the carton with the loose fill material surrounding it and filling the carton. The flap holders are affixed to the inner flaps 16, 17 of the carton by removing the protective backings 31 from end sections 26 and attaching those sections to the flaps toward the upper or outer edges of the flaps, with the fold lines 28 aligned with the side edges. End sections 27 are folded back over end sections 26, with protective backings 32 and instructions 34 facing in an outward or upward direction. The two flap holders are attached to opposite ends of the two end flaps so that they will be diametrically opposed to each other when the flaps are upright. The inner flaps are folded down over the packing material, and the outer flaps 18, 19 are folded over the inner flaps and secured by conventional means such as taping.

To unpack the carton, outer flaps 18, 19 are opened, exposing the flap holders on the inner panels, with the instructions for their use 34 facing in an upward direction. All four flaps are raised to an upright position. Protective backings 32 are removed from end sections 27, and those end sections are folded around the corners and affixed to the adjacent edge portions of side flaps 18, 19. Being thus affixed to the flaps at opposite corners of the carton, the strips hold the flaps in the upright position. With the height or depth of the carton thus effectively increased, a person can dig around in the packing material for the article and remove it from the carton without spilling the packing material over the sides of the carton.

With the strips attached to the two corners, the instructions 36 for recycling the packing material will be facing in an outward direction and should be readily visible to the person unpacking the carton.

Figure 5:
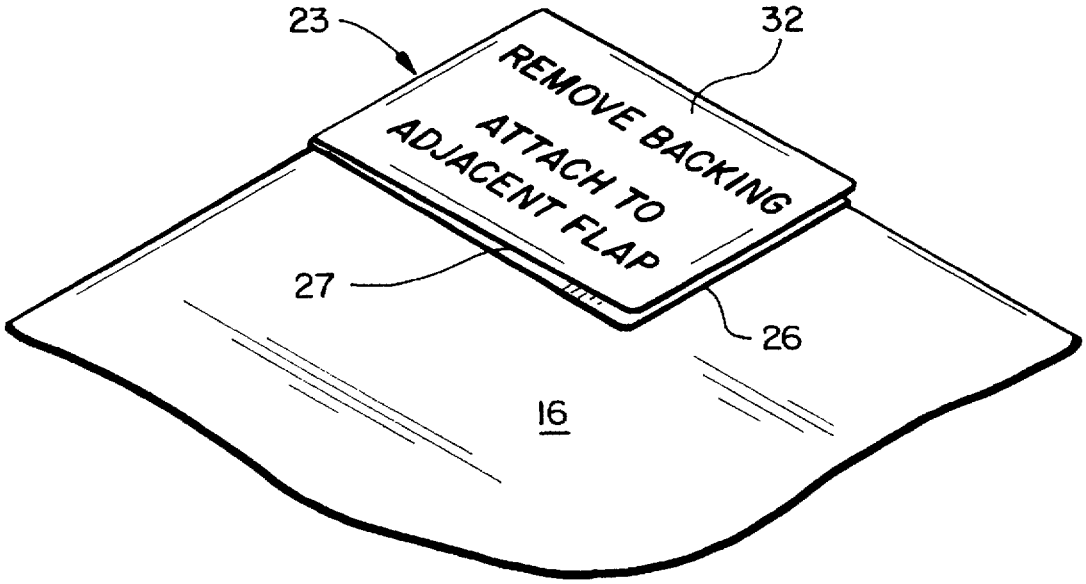
FIG. 5 is an enlarged fragmentary view of the embodiment of FIG. 1.
Figure 6:
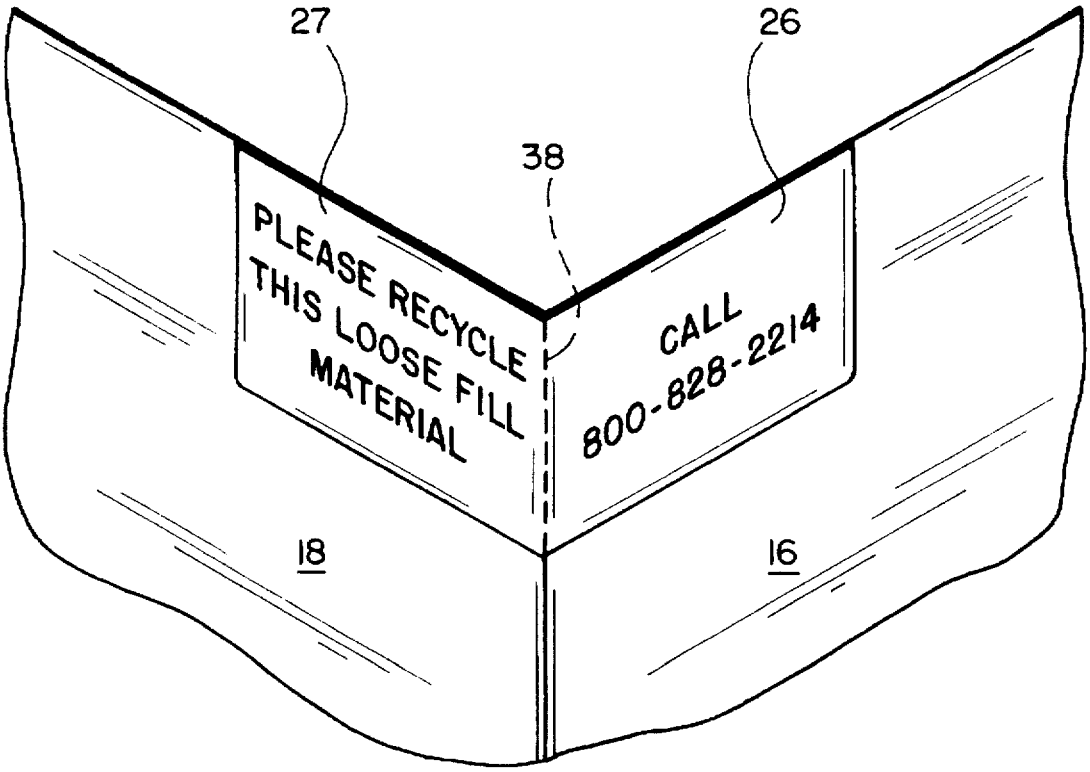
FIG. 6 is a fragmentary isometric view of a shipping carton with another embodiment of a flap holder in accordance with the invention.

To reclose the carton, the strips can be torn or cut along the fold lines 28 and the flaps returned to their closed positions. If desired, the strips can be formed with lines of weakness along the fold lines to facilitate severance of the two end sections, and in the embodiment of FIG. 5, the flap holder is shown as having a line of perforations 38 along the fold line.

The invention has a number of important features and advantages. It provides a simple, effective way of eliminating the spillage of loose fill materials in the unpacking of articles shipped in them. Because of the manner in which the strips are folded and applied to the cartons, instructions for their use are always visible to the person using them.

It is apparent from the foregoing that a new and improved shipping carton and flap holder have been provided. While only certain presently preferred embodiments have been described in detail, as will be apparent to those familiar with the art, certain changes and modifications can be made without departing from the scope of the invention as defined by the following claims.

I claim:

1. In combination:

a shipping carton having first and second closure flaps movable between open and closed positions;

a loose fill packing material disposed within and substantially filling the carton: and a flap holder attached to the first flap and engagable with the second flap for holding the flaps in their open position to prevent spillage of the loose fill material when an article packed in the material is removed from the carton, the flap holder comprising a strip of material having a first portion affixed toward an edge of the one flap and a second portion which extends from the first portion and is movable between an overlying position in which the second portion is folded back on top of the first portion and an extended position in which the second portion extends from the edge of the first flap for engagement with the second flap, an adhesive on the second portion of the strip for securing the second portion to the second flap, a removable backing covering the adhesive when the second portion of the strip is in the overlying position, and instructions for use of the flap holder printed on the backing.

2. In combination:

a shipping carton having first and second closure flaps movable between open and closed positions;

a loose fill packing material disposed within and substantially filling the carton; and a flap holder attached to the first flap and engagable with the second flap for holding the flaps in their open position to prevent spillage of the loose fill material when an article packed in the material is removed from the carton, the flap holder comprising a strip of material having a first portion affixed toward an edge of the one flap and a second portion which extends from the first portion and is movable between an overlying position in which the second portion is folded back on top of the first portion and an extended position in which the second portion extends from the edge of the first flap for engagement with the second flap, an adhesive on the second portion of the strip for securing the second portion to the second flap, and a removable backing covering the adhesive when the second portion of the strip is in the overlying position, the strip being weakened between the first and second portions to facilitate severance of the two portions and closure of the flaps after the article has been removed from the carton.

3. A flap holder for use with a shipping carton in which an article is packed in a loose fill material, comprising a strip having first and second end portions with an adhesive for attachment to adjacent flaps of the carton to hold the flaps in an open position and thereby prevent spillage of the material when the article is removed from the carton, separately removable backings covering the adhesive on the two end portions of the strip whereby the strip can be affixed to one flap and folded back upon itself for shipment, and thereafter the second backing can be removed and the second end portion can be folded over and affixed to the adjacent flap, and instructions for use printed on the backings.

4. The flap holder of claim 3 wherein the backings are of greater lateral extent than the strip to facilitate removal of the backings from the strip.

5. A flap holder for use with a shipping carton in which an article is packed in a loose fill material, comprising a strip having first and second end portions with an adhesive for attachment to adjacent flaps of the carton to hold the flaps in an open position and thereby prevent spillage of the material when the article is removed from the carton, separately removable backings covering the adhesive on the two end portions of the strip whereby the strip can be affixed to one flap and folded back upon itself for shipment, and thereafter the second backing can be removed and the second end portion can be folded over and affixed to the adjacent flap, and a line of perforations between the two end portions to facilitate severance of the strip and closure of the flaps after the article has been removed from the carton.

6. The flap holder of claim 5 wherein the backings are of greater lateral extent than the strip to facilitate removal of the backings from the strip.

* * * * *